US010509355B2

(12) United States Patent
Makino et al.

(10) Patent No.: US 10,509,355 B2
(45) Date of Patent: Dec. 17, 2019

(54) IMAGE FORMING APPARATUS

(71) Applicant: CANON KABUSHIKI KAISHA, Tokyo (JP)

(72) Inventors: Masahiro Makino, Tsukubamirai (JP); Ryuta Ai, Tokyo (JP); Yuichi Hatanaka, Kashiwa (JP); Takashi Ueno, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/034,496

(22) Filed: Jul. 13, 2018

(65) Prior Publication Data

US 2018/0321623 A1 Nov. 8, 2018

Related U.S. Application Data

(62) Division of application No. 15/421,532, filed on Feb. 1, 2017, now Pat. No. 10,139,766.

(30) Foreign Application Priority Data

Feb. 8, 2016 (JP) ..... 2016-022166

(51) Int. Cl.

| | |
|---|---|
| ***G03G 15/00*** | (2006.01) |
| ***G03G 15/02*** | (2006.01) |
| ***G03G 21/18*** | (2006.01) |

(52) U.S. Cl.

CPC ..... *G03G 15/55* (2013.01); *G03G 15/0216* (2013.01); *G03G 15/553* (2013.01); *G03G 21/1889* (2013.01)

(58) Field of Classification Search

None

See application file for complete search history.

(56) References Cited

U.S. PATENT DOCUMENTS 6,131,011 A * 10/2000 Kojima ..... G03G 21/1821 399/111

6,850,714 B2 2/2005 Sakurai et al.

(Continued)

FOREIGN PATENT DOCUMENTS

JP H09-211931 A 8/1997

JP 11194557 A * 7/1999

(Continued)

OTHER PUBLICATIONS

U.S. Appl. No. 15/332,154, filed Oct. 24, 2016, First Named Inventor: Takashi Ueno.

*Primary Examiner* — Clayton E. LaBalle

*Assistant Examiner* — Leon W Rhodes, Jr.

(74) *Attorney, Agent, or Firm* — Venable LLP

(57) ABSTRACT

An image forming apparatus includes a photosensitive member; a charging member configured to electrically charge the photosensitive member; a developing device configured to form a toner image by supplying toner to the photosensitive member; a transfer member configured to transfer the toner image from the photosensitive member onto a toner image receiving member; a cleaning member provided in contact with the photosensitive member and configured to remove the toner remaining on a surface of the photosensitive member after transfer; and a controller configured to carry out a process for notifying information on a lifetime of the charging member, on the basis of use amount information on a use amount of the charging member and contact pressure information on contact pressure applied by the cleaning member to the photosensitive member.

8 Claims, 7 Drawing Sheets

(56) References Cited

U.S. PATENT DOCUMENTS

| | | | | |
|---|---|---|---|---|
| 7,251,433 | B2 | 7/2007 | Ai et al. | |
| 7,272,344 | B2 | 9/2007 | Miura et al. | |
| 7,343,133 | B2 | 3/2008 | Ueno | |
| 7,430,378 | B2 * | 9/2008 | Inami | G03G 15/553 399/12 |
| 7,590,365 | B2 | 9/2009 | Miyaji et al. | |
| 7,668,478 | B2 | 2/2010 | Ai | |
| 7,764,917 | B2 | 7/2010 | Ueno | |
| 8,095,032 | B2 | 1/2012 | Torimaru et al. | |
| 8,135,303 | B2 | 3/2012 | Ai et al. | |
| 8,224,199 | B2 | 7/2012 | Ai | |
| 8,953,973 | B2 | 2/2015 | Aiba et al. | |
| 9,075,371 | B2 | 7/2015 | Ueno | |
| 9,235,165 | B2 | 1/2016 | Makino | |
| 9,268,265 | B2 | 2/2016 | Ai | |
| 9,310,707 | B2 * | 4/2016 | Seki | G03G 15/0275 |
| 9,348,267 | B2 | 5/2016 | Ai | |
| 9,400,469 | B2 | 7/2016 | Nakai | |
| 2005/0135852 | A1 | 6/2005 | Sekiguchi | |
| 2007/0127935 | A1 * | 6/2007 | Inami | G03G 15/065 399/12 |
| 2011/0129270 | A1 | 6/2011 | Seo et al. | |
| 2016/0306303 | A1 | 10/2016 | Ueno | |
| 2017/0052494 | A1 * | 2/2017 | Yoshida | G03G 15/553 |

FOREIGN PATENT DOCUMENTS

| | | | |
|---|---|---|---|
| JP | 2001-154512 | A | 6/2001 |
| JP | 2003-140449 | A | 5/2003 |
| JP | 2010-091976 | A | 4/2010 |
| JP | 2016-009010 | A | 1/2016 |

* cited by examiner

IMAGE FORMING APPARATUS

This is a divisional of U.S. patent application Ser. No. 15/421,532,filed Feb. 1, 2017.

FIELD OF THE INVENTION AND RELATED ART

The present invention relates to an image forming apparatus, such as a copying machine, a printer, a facsimile machine or a multifunction machine having functions of these machines, of an electrophotographic type In the image forming apparatus of the electrophotographic type, as a charging means for electrically charging a photosensitive member, a charging member provided in contact with the photosensitive member is used. Of the charging member, a charging roller which is a rotatable roller-type charging member is used widely. Further, a cleaning member provided in contact with the photosensitive member is used as a cleaning means for removing toner (transfer residual toner) remaining on a surface of the photosensitive member after a toner image is transferred from the photosensitive member onto a toner image receiving member and for removing another deposited matter such as an external additive for the toner. Of the cleaning member, a cleaning blade which is a plate-like (blade-like) cleaning member having elasticity is used widely.

However, the photosensitive member on the photosensitive member passes through the cleaning blade in some cases and is transferred and accumulated on the charging roller in some cases. When an accumulation amount of the deposited matter on the charging roller is not less than a tolerable amount of the accumulation amount, a surface resistance at that portion changes, so that non-uniformity in charge potential of the photosensitive member generates and image non-uniformity generates, and lead to a lowering in image quality. In this regard, Japanese Laid-Open Patent Application 2010-91976 proposes a technique (means) for cleaning the charging roller.

However, even when the means for contact the charging roller is used, it is difficult to completely remove the deposited matter on the charging roller, and when a use amount of the charging roller increases, the image non-uniformity due to the deposited matter generates. For that reason, in general, there is a need to exchange the charging roller or a unit (replacement part) including the charging roller.

Incidentally, in order to stably operate the image forming apparatus efficiently, it is desired that a lifetime of the replacement part is discriminated with high accuracy and preparation or exchange of the replacement part is carried out before an inconvenience generates. However, as regards the deposited matter on the charging roller, the deposited matter is removed in many cases after image defect such as the image non-uniformity generates. This is partly because it is difficult to accurately estimate an accumulation amount of the deposited matter on the charging roller.

SUMMARY OF THE INVENTION

According to an aspect of the present invention, there is provided an image forming apparatus comprising: a photosensitive member; a charging member configured to electrically charge the photosensitive member; a developing device configured to form a toner image by supplying toner to the photosensitive member; a transfer member configured to transfer the toner image from the photosensitive member onto a toner image receiving member; a cleaning member provided in contact with the photosensitive member and configured to remove the toner remaining on a surface of the photosensitive member after transfer; and a controller configured to carry out a process for notifying information on a lifetime of the charging member, on the basis of use amount information on a use amount of the charging member and contact pressure information on contact pressure applied by the cleaning member to the photosensitive member.

Further features of the present invention will become apparent from the following description of exemplary embodiments with reference to the attached drawings.

DESCRIPTION OF THE EMBODIMENTS

An image forming apparatus according to the present invention will be described with reference to the drawings.

[Embodiment 1]

1. General Constitution and Operation of Image Forming Apparatus

Figure 1:
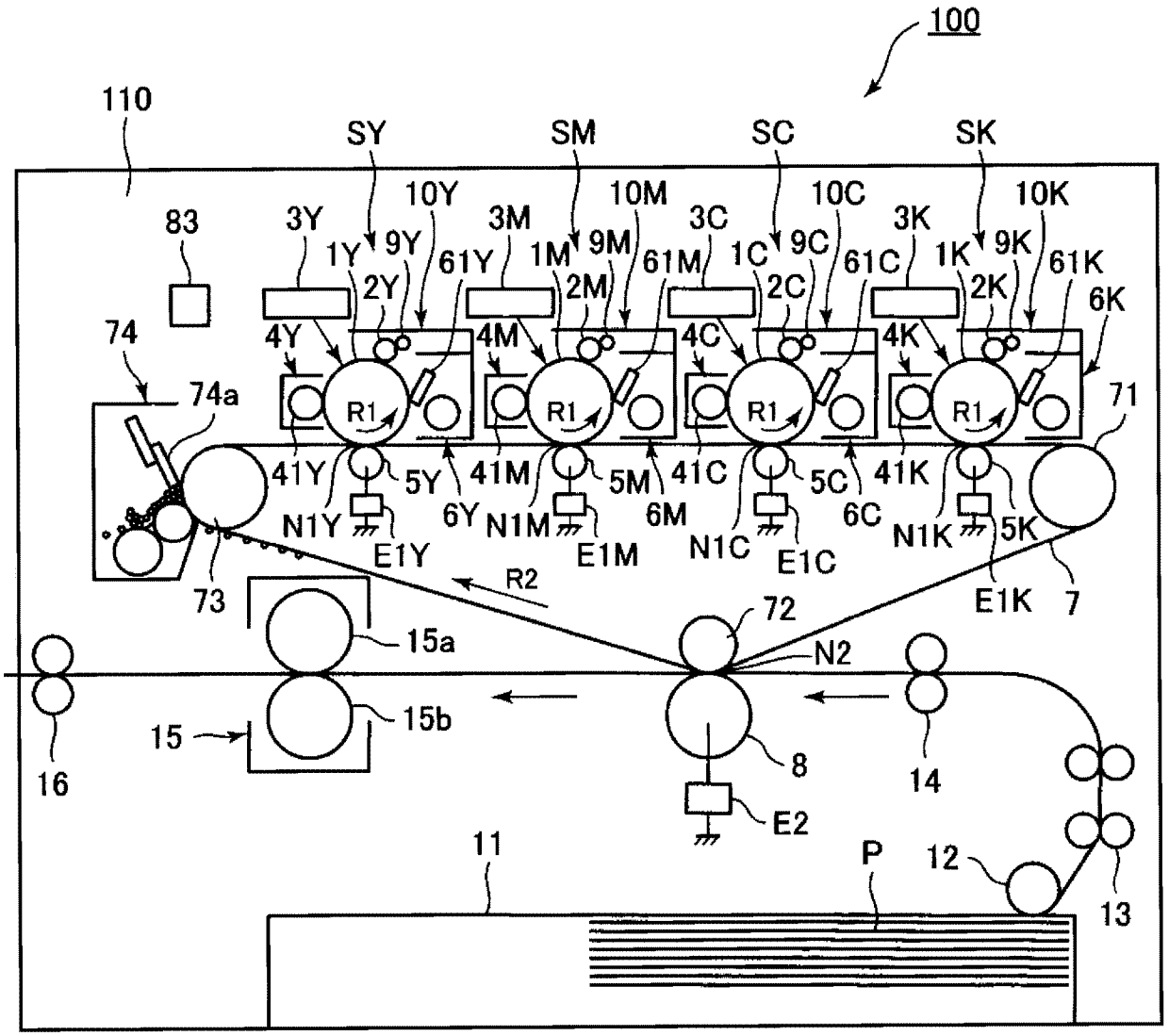
FIG. 1 is a schematic sectional view of an image forming apparatus.

FIG. 1 is a schematic sectional view of an image forming apparatus 100 in this embodiment according to the present invention.

The image forming apparatus 100 in this embodiment is a tandem-type printer employing an intermediary transfer type capable of forming a full-color image.

The image forming apparatus 100 includes, as a plurality of image forming portions (stations), first to fourth image forming portions SY, SM, SC and SK for forming images of yellow (Y), magenta (M), cyan (C) and black (K), respectively. In this embodiment, constitutions and operations of the first to fourth image forming portions SY, SM, SC and SK are substantially the same except that the colors of toners used are different from each other. Accordingly, in the case where particular distinction is not required, suffixes Y, M, C and K for representing elements for associated colors are omitted, and the elements will be collectively described. In this embodiment, the image forming portion S is constituted by a photosensitive drum 1, a charging roller 2, an exposure device 3, a developing device 4, a primary transfer roller 5, a drum cleaning device 6, a cleaning roller 9, and the like, which are described later.

At the image forming portion S, the photosensitive drum 1 which is a drum-shaped (cylindrical) rotatable photosensitive member (electrophotographic photosensitive member) as an image bearing member is provided.

The photosensitive drum 1 is rotationally driven in an indicated arrow R1 direction (counterclockwise direction) at a predetermined peripheral speed (process speed). A surface of the rotating photosensitive drum 1 is electrically charged to a predetermined polarity (negative in this embodiment) and a predetermined potential by the charging roller 2 which is a roller-type charging member as a charging means. During a charging step, to the charging roller 2, a charging voltage (charging bias) which is an oscillating voltage in the form of a negative DC voltage biased with an AC voltage is applied. Incidentally, in this embodiment, as a charging member cleaning means, the cleaning roller 9 is disposed in contact with the charging roller 2.

The surface of the charged photosensitive drum 1 is exposed to light depending on image information by the exposure device 3 as an exposure means, so that an electrostatic latent image (electrostatic image) is formed on the photosensitive drum 1. In this embodiment, the exposure device 3 is a laser scanner for carrying out scanning exposure with laser light of wavelength $\lambda$=780 nm. The exposure device 3 scans the photosensitive drum surface by a rotating mirror with a laser beam subjected to ON-OFF modulation depending on scanning line image data developed from an image of separated color corresponding to the image forming portion S, and thus writes (forms) the electrostatic latent image on the surface of the charged photosensitive drum 1.

The electrostatic image formed on the photosensitive drum 1 is developed (visualized) by supplying the toner by the developing device 4, so that the toner image is formed on the photosensitive drum 1. In this embodiment, the developing device 4 is a two-component developing device using a two-component developer in which toner (non-magnetic toner particles) as a developer and a carrier (magnetic carrier particles) are mixed with each other. The developing device 4 carries the two-component developer on a developing sleeve 41 as a developer carrying member and feeds the developer to an opposing portion to the photosensitive drum 1, and deposits the toner of the two-component developer on the photosensitive drum 1 depending on the electrostatic latent image, so that the toner image is formed. During a developing step, to the developing sleeve 41, a developing voltage (developing bias) which is an oscillating voltage in the form of a negative DC voltage biased with an AC voltage is applied. As a result, the toner negatively charged to the same polarity as the charge polarity of the photosensitive drum 1 is transferred onto an exposed portion of the photosensitive drum 1 which is lowered in absolute value of the potential by the exposure to light after the photosensitive drum 1 is charged and which has the positive polarity relative to the developing sleeve 41 (reverse development).

An intermediary transfer belt 7 constituted by an endless belt as an intermediary transfer member is provided opposed to the respective photosensitive drums 1 of the image forming portions S. The intermediary transfer belt 5 is extended around a driving roller 71, a secondary transfer opposite roller 72 and a tension roller 73 which are used as stretching rollers, and is stretched with a predetermined tension. The intermediary transfer belt 7 is rotationally driven by the driving roller 71 in an indicated arrow R2 direction (clockwise direction) at a peripheral speed corresponding to the peripheral speed of the photosensitive drum 1. In an inner peripheral surface side of the intermediary transfer belt 7, the primary transfer roller 5 which is a roller-type primary transfer member as a primary transfer means is provided corresponding to the photosensitive drum 1. The primary transfer roller 5 is pressed (urged) against the intermediary transfer belt 7 toward the photosensitive drum 1, so that a primary transfer portion (primary transfer nip) N1 where the photosensitive drum and the intermediary transfer belt 7 contact each other.

The toner image formed on the photosensitive drum 1 is transferred (primary-transferred) by the action of the primary transfer roller 5 onto the intermediary transfer belt 7 as a toner image receiving member at the primary transfer portion N1. During a transfer step, to the primary transfer roller 5, a primary transfer voltage (primary transfer bias) which is a DC voltage of an opposite polarity to the charge polarity (positive in this embodiment) of the toner during the development is applied from a primary transfer voltage source E1. For example, during full-color image formation, the respective color toner images of yellow, magenta, cyan and black formed on the respective photosensitive drums 1 are successively transferred superposedly onto the intermediary transfer belt 7. Toner (transfer residual toner) and a deposited matter such as an external additive which step remain on the surface of the photosensitive drum 1 after a primary transfer are removed and collected from the surface of the photosensitive drum 1 by the drum cleaning device 6 as a photosensitive member cleaning means. The drum cleaning device 6 rubs the surface of the photosensitive drum 1 with a cleaning blade 61 as a cleaning member, and collects the toner and the deposited matter on the photosensitive drum 1.

At a position opposing the secondary transfer opposite roller 72 on an outer peripheral surface side of the intermediary transfer belt 7, a secondary transfer roller 8 which is a roller-type secondary transfer member as a secondary transfer means is provided. The secondary transfer roller 8 is (pressed (urged) against the intermediary transfer belt 7 toward the secondary transfer opposite roller 72 and forms a secondary transfer portion (secondary transfer nip) N2 where the intermediary transfer belt 7 and the secondary transfer roller 8 are in contact with each other.

The toner images formed on the intermediary transfer belt 7 as described above are transferred (secondary-transferred) by the action of the secondary transfer roller 8 onto the recording material P, such as paper as a toner image receiving member, nipped and fed at the secondary transfer portion N2 by the intermediary transfer belt 7 and the secondary transfer roller 8. During a secondary transfer step, to the secondary transfer roller 8, a secondary transfer voltage (secondary transfer bias) which is a DC voltage of an opposite polarity to the normal charge polarity of the toner during is applied from a secondary transfer voltage source E2. The recording material P is accommodated in a recording material cassette 11 and is pulled out from the recording material cassette 11 by a pick-up roller 12, and then is separated one by one by a separation roller 13, so that the recording material P is fed to a registration roller pair 14. Then, the recording material P fed to the secondary transfer portion N2 while being timed to the toner images on the intermediary transfer belt 7 by the registration roller pair 14.

The recording material P on which the toner images are transferred is fed to a fixing device 15 as a fixing means and is heated and pressed at a nip between a heating roller 15*a* and a pressing roller 15*b* which constitute the fixing device 15, so that the toner images are fixed (melt-fixed) on the surface of the recording material P. The recording material P on which the toner images are fixed is discharged to an outside of the apparatus main assembly 110 of the image forming apparatus 100.

Further, toner (transfer residual toner) and a deposited matter such as an external additive, which remain on the surface of the intermediary transfer belt 7 after a secondary transfer step is removed and collected from the surface of the intermediary transfer belt 7 by a belt cleaning device 74 as an intermediary transfer member cleaning means. The belt cleaning device 74 rubs the surface of the intermediary transfer belt 7 with a cleaning blade 74*a* which is a cleaning member, and collects the deposited matter on the intermediary transfer belt 7.

In this embodiment, at each of the image forming portions S, the photosensitive drum 1, the charging roller 2, the drum cleaning device 6 and the cleaning roller 9 integrally constitute a drum cartridge 10 detachably mountable to the apparatus main assembly 110. Further, at each image forming portion S, the developing device 4 constitutes a developing cartridge detachably mountable to the apparatus main assembly 110.

Figure 5:
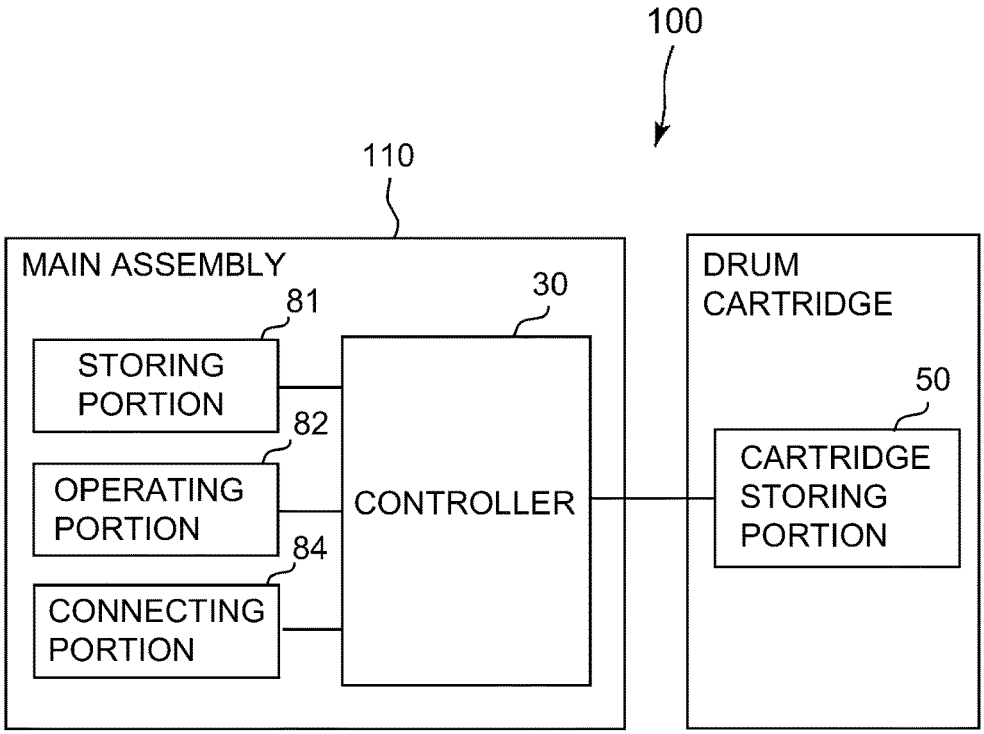
FIG. 5 is a block diagram showing a general control mode of the image forming apparatus.

Further, in this embodiment, operations of the respective portions of the image forming apparatus 100 are controlled by a controller 30 (FIG. 5) as a control means provided in the apparatus main assembly 110 of the image forming apparatus 100. The controller 30 includes a computation controller (CPU), storing portions (ROM, RAM) and the like, and effects integrated control of the operations of the respective portions of the image forming apparatus 100 in accordance with programs and data stored in the storing portions thereof.

Here, the image forming apparatus 100 performs a series of image outputting operations (job, print operation) which is started by a start instruction (command) and in which an image is formed on a single or a plurality of recording materials P and then the recording materials P are outputted. The job generally includes an image forming step, a pre-rotation step, a sheet interval step in the case where the image is formed on the plurality of the recording materials P, and a post-rotation step. The image forming step is a period in which formation of the electrostatic latent image for an image formed and outputted on the recording material P, formation of the toner image, and primary transfer and secondary transfer of the toner image are actually performed, and "during image formation" refers to this period. Specifically, at each of positions where steps of effecting the formation of the electrostatic latent image, the formation of the toner image, and the primary transfer and the secondary transfer of the toner image, timing during image formation is different. The pre-rotation step is a period in which a preparatory operation, from input of the start instruction until the image formation is actually started, before the image forming step is performed. The sheet interval step is a period corresponding to an interval between a recording material P and a subsequent recording material P when the image formation is continuously performed (continuous image formation) with respect to the plurality of recording materials P. The post-rotation step is a period in which a post-operation (preparatory operation) after the image forming step is performed. "During non-image formation" refers to a period other than "during image formation", and includes the pre-rotation step, the sheet interval step, the post-rotation step and further includes a pre-multi-rotation step which is a preparatory operation during main switch actuation of the image forming apparatus 100 or during restoration from a sleep state.

2. Photosensitive Drum

Figure 2:
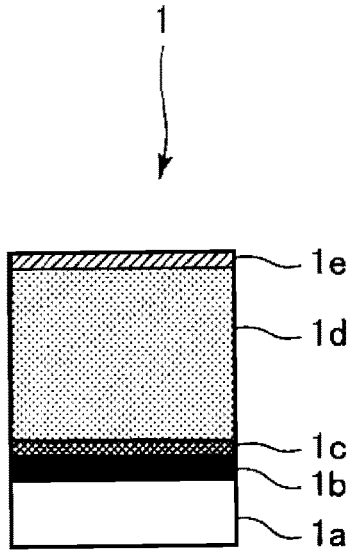
FIG. 2 is a sectional view showing a layer structure of a photosensitive drum.

FIG. 2 is a sectional view showing a layer structure of the photosensitive drum 1. In this embodiment, the photosensitive drum 1 includes a lamination-type OPC photosensitive layer in which an electroconductive substrate (supporting member) 1*a* having electroconductivity, a charge-generating layer 1*c* and a charge-transporting layer 1*d* are successively laminated. In this embodiment, the electroconductive substrate 1*a* is an aluminum cylinder. Further, in this embodiment, on the surface of the electroconductive substrate 1*a*, an undercoat layer 1*b* having a barrier function and an adhesive function is provided. The undercoat layer 1*b* is formed for the purpose of improvement of an adhesive property of the photosensitive layer, improvement of a coating property, protection of the electroconductive substrate 1*a*, coating of unevenness on the electroconductive substrate 1*a*, improvement of a charge injection property from the electroconductive substrate 1*a*, protection of the photosensitive layer against electrical breakdown, and the like. Further, in this embodiment, a surface protection layer 1*d* is formed on the photosensitive layer of a function separation type in which the charge-generating layer 1*c* and the charge-transporting layer 1*d* are successively laminated.

In this embodiment, the surface of the photosensitive drum 1 is abraded by an abrading tape (lapping paper), buffing or the like, so that a ten-point average roughness Rz (JIS B0601-1982) is 0.2-2 μm.

3. Developer

In this embodiment, the developer (two-component developer) in which the carrier and the toner were mixed in a weight ratio of 91:9 (toner content:9%) was used. Further, a total weight of an initial developer accommodated in the developing device 4 was 350 g.

As the carrier, ferrite particles coated with a silicone resin material were used. This carrier is 24 ($Am^2/kg$) in saturation magnetization under application of a magnetic field of 240 (kA/m), $1\times10^7$ (Ω.cm)-$1\times10^8$ (Ω.cm) in resistivity at electric field intensity of 3000 (V/cm) and 50 μm in weight-average particle size.

The toner is constituted by containing at least a binder, a colorant and a charge control agent. In this embodiment, as a binder resin material, a styrene-acrylic resin material was used. However, it is also possible to use resin materials of styrenes, polyesters, polyethylene and the like. As the colorant, various pigments, dyes and the like may be used singly or in combination of a plurality of kinds. The charge control agent may also contain a charge controlling agent for assisting the charge control agent as desired. As the charge controlling agent for assisting the charge control agent, it is possible to use a nigrosine-based dye, a triphenylene-based dye, and the like. The weight-average particle size of the toner is 5.7 μm.

Further, the toner contains a wax. The wax is contained for improving a parting property from a fixing member and improving a fixing property during fixation. As the wax, a paraffin wax, carnauba wax, polyolefin or the like can be used, and is used in a state in which the wax is kneaded and dispersed in the binder resin material. In this embodiment, as the toner, toner obtained by pulverizing a resin material, obtained by kneading and dispersing the binder, the colorant, the charge control agent and the wax, by a mechanical pulverizer was used.

Further, into the toner, an external additive is added (externally added). As the external additive, fine particles of amorphous silica subjected to hydrophobization or fine particles of inorganic oxides such as titanium oxide and a titanium compound may be used. These fine particles are added to the toner, so that it is possible to adjust powder flowability and a charge amount of the toner. A particle size of the external additive may preferably be 1 nm or more and 100 nm or less. In this embodiment, titanium oxide fine particles of 50 nm in average particle size were added in a weight ratio of 0.5 wt. % with respect to the toner base material, and amorphous silica fine particles of 2 nm in average particle size and amorphous silica fine particles of 100 nm in average particle size were added in weight ratios of 0.5 wt. % and 1.0 wt. %, respectively, with respect to the toner base material.

In the developing device 4, when the developer is stirred, the toner is charged to the negative polarity, and the carrier is charged to the positive polarity. The charged developer rubs the photosensitive drum 1 in a state in which the developer is carried and erected on the developing sleeve 41 in which a magnet member is fixedly provided at a hollow portion.

4. Charging Roller, Cleaning Roller

In this embodiment, the charging roller 2 is constituted by forming, on a core metal of 8 mm in diameter, as an elastic layer, a 3 mm-thick EPDM rubber layer having an ion-conductive property and by coating the surface of the elastic layer with an about 20 μm-thick surface layer of an electroconductive material obtained by dispersing carbon black in an acrylic resin material. The elastic layer is integrally molded on the core metal through a die molding. Further, a length of the charging roller 2 with respect to a longitudinal direction is longer than an image forming region (in which the toner image is formable) of the photosensitive drum 1 with respect to a longitudinal direction, so that the image forming region falls within a range of the length of the charging roller 2 with respect to the longitudinal direction. The charging roller 2 is pressed and contacted to the photosensitive drum 1 with a total pressure of about 800 gf by a spring as an urging means. The charging roller 2 is rotated by the photosensitive drum 1 by a frictional force with the photosensitive drum 1.

Further, in this embodiment, the cleaning roller 9 is a roller which is prepared by forming an urethane sponge-made elastic layer on a core metal and which is 12 mm in diameter. The cleaning roller 9 is pressed and contacted to the charging roller 2. The cleaning roller 9 is rotated by the charging roller 2 by a frictional force with the charging roller 2. Further, by the frictional force during the rotation of the cleaning roller 9 by the charging roller 2, the toner and the deposited matter such as the external additive for the toner, which are deposited on the charging roller 2 are removed.

Here, the charging roller 2 is not necessarily be pressed and contacted to the photosensitive drum 1, and may also be disposed close to the photosensitive drum 1 with a gap of, e.g., several hundreds of μm. In the case where the charging roller 2 is disposed in contact with the photosensitive drum 1, the charging roller 2 electrically charges the photosensitive drum 1 by electric discharge generating in minute gaps formed in sides upstream and downstream of a contact portion between the charging roller 2 and the photosensitive drum 1 with respect to a rotational direction of the photosensitive drum 1. Also in the case where the charging roller 2 is disposed close to the photosensitive drum 1, similarly, the charging roller 2 charges the photosensitive drum 1 by the electric discharge generating in a minute gap between the charging roller 2 and the photosensitive drum 1.

Further, the cleaning member is not required to be the rubber roller, but may also be a roller-like brush member constituted by, e.g., a plurality of electroconductive fibers. Further, the cleaning member is not required to be the roller-like member, but may also be a rotatable endless belt-like member, and a pad-like member and a sheet-like member which are provided at a fixed position.

Further, the cleaning roller 9 is not required to be the sponge roller, but may also be a roller-like brush constituted by, e.g., a plurality of fibers. Further, the charging member cleaning means is not required to be the roller-like member, but may also be a rotatable endless belt-like member, and pad-like and sheet-like members which are provided at a fixed position.

5. Drum Cleaning Device

Figure 3:
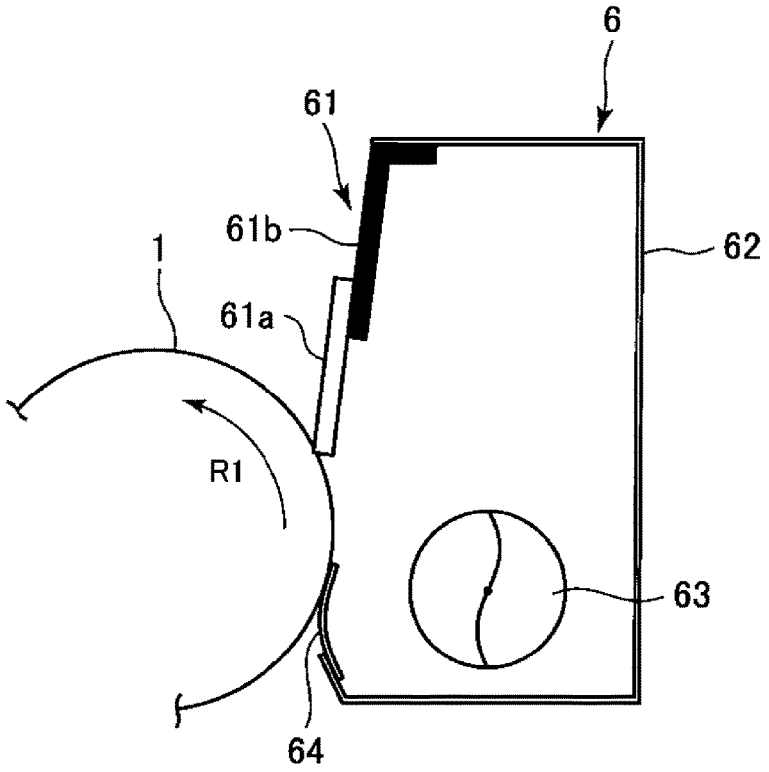
FIG. 3 is a sectional view of a drum cleaning device.

FIG. 3 is a sectional view showing the drum cleaning device 6 together with the photosensitive drum 1 in this embodiment. In this embodiment, the cleaning blade 61 is constituted by a supporting portion 61*b* formed with a metal plate and a rubber portion 61*a* formed of a rubber material having proper elasticity and hardness.

In this embodiment, as a material of the rubber portion 61*a*, polyurethane (urethane rubber) was employed since the polyurethane did not damage the photosensitive drum 1 and was large in anti-wearing property. When small permanent strain is taken into consideration, a two-part curable polyurethane may also be employed. It is also possible to employ, other than the polyurethane, a styrene-butadiene copolymer, chloroprene, butadiene rubber, ethylene-propylene-diene-based rubber, chlorosulfonated polyethylene rubber, fluorine-containing rubber, silicone rubber, and the like.

In this embodiment, the rubber portion 61*a* is formed by molding in a size of 340 mm in longitudinal length, 15 mm in widthwise length and 2 mm in thickness, and a length (free length) of a portion, with respect to the widthwise direction, which is not supported by the supporting portion 61*b* is 8 mm. The cleaning blade 61 is disposed so that a longitudinal direction of the rubber portion 61*a* is substantially parallel to a longitudinal direction (rotational axis direction) of the photosensitive drum 1. Further, a longitudinal length of the rubber portion 61*a* is longer than an image forming region with respect to the longitudinal direction of the photosensitive drum 1, so that the image forming region falls within the longitudinal length of the rubber portion 61*a*.

The cleaning blade 61 is contacted to the photosensitive drum 1 at an edge portion of the rubber portion 61*a* so that a free end of the rubber portion 61*a* faces toward an upstream side of the rotational direction of the photosensitive drum 1. Particularly, in this embodiment, a constitution in which the cleaning blade 61 is disposed downwardly and rubs a surface-to-be-cleaned of the photosensitive drum 1 which moves upwardly and thus cleaning power is relatively high is employed. The cleaning blade 61 is mounted to a housing 62 in a state in which the cleaning blade 61 is urged so as to provide a predetermined entering amount into the photosensitive drum 1.

A lower portion in the housing 62 is an accommodating portion for accommodating the transfer residual toner and the like collected from the surface of the photosensitive drum 1 by the cleaning blade 61, and at this accommodating portion, a feeding screw 63 as a feeding means is provided. The feeding screw 63 feeds the transfer residual toner and the like, collected in the housing 62, toward one end side of the cleaning device 6 with respect to the longitudinal direction, so that the transfer residual toner and the like are collected in an external collecting container (not shown) of the cleaning device 6. Further, at a lower edge portion of the housing 62 at a position opposing the photosensitive drum 1, a scattering preventing sheet 64 for suppressing scattering of the transfer residual toner and the like from an inside to an outside of the housing 62 is provided. In this embodiment, the scattering preventing sheet 64 is formed of a sheet material of polyethylene terephthalate resin and having a thickness of 20 μm-50 μm, and a free end in a free-end side thereof is provided in contact with the photosensitive drum 1.

In this embodiment, the cleaning device 6 has a constitution in which a cleaning performance is relative high as described above, and the charging roller 2 has a constitution in which the charging roller 2 is cleaned by the cleaning roller 9. However, it is difficult to completely remove the deposited matter on the photosensitive drum 1 by the cleaning device 6. Further, it is difficult to completely remove the deposited matter on the charging roller 2 by the cleaning roller 9. For that reason, with an increasing use amount of the charging roller 2 from an unused state, the deposited matter on the photosensitive drum 1, such as the toner and the external additive for the toner which passed through the cleaning blade 61 is transferred onto the charging roller 2 and is gradually accumulated on the charging roller 2.

When the deposited matter is accumulated on the charging roller 2 in a tolerable amount or more, image defect such as image non-uniformity due to charging non-uniformity generates in some cases. For that reason, it is desired that a deposited state (contaminated state) of the deposited matter on the charging roller 2 is discriminated and then the charging roller 2 or a unit (the drum cartridge 10 in this embodiment) including the charging roller 2 is exchanged before an inconvenience generates.

Conventionally, in order to prevent the inconvenience due to the deposited matter on the charging roller 2, a lifetime of the charging roller 2 is determined depending on a use amount (such as a rotation distance or a charging time) of the charging roller 2 and then the charging roller 2 is exchanged when the charging roller 2 reaches an end of the lifetime thereof. However, even when the lifetime of the charging roller 2 is set on the basis of only the use amount of the charging roller 2, it is difficult to discriminate the end of the lifetime of the charging roller 2 with accuracy. For that reason, in some cases, the charging roller 2 is discriminated that it reaches the end of the lifetime at timing when there is no need to exchange the charging roller 2, and is exchanged early, or on the other hand, although the charging roller 2 is discriminated that it does not reach the end of the lifetime yet, image defect such as image non-uniformity generates.

As a result of study by the present inventors, it turned out that a contact pressure (also referred to as "blade pressure") applied by the cleaning blade 61 to the photosensitive drum 1 is deeply involved in the deposited state of the deposited matter on the charging roller 2. Typically, in the case where the blade pressure is relatively small, compared with the case where the blade pressure is relatively large, an amount of the deposited matter on the photosensitive drum 1 passing through the cleaning blade 61 is large, so that an amount of the deposited matter transferred and accumulated on the charging roller 2 is liable to increase.

Therefore, in this embodiment, the deposited state of the deposited matter on the charging roller 2 is estimated from information on the blade pressure (contact pressure information) and information on the use amount of the charging roller 2 (use amount information). As a result, the deposited state of the deposited matter on the charging roller 2 can be discriminated with accuracy. This will be described specifically below.

5. Measurement of Blade Pressure

The blade pressure can be measured by using a load cell (load sensor). The present invention is not limited thereto, but in this embodiment, the blade pressure was measured in the following manner.

A blade pressure measuring device (jig) is constituted by including the photosensitive drum 1, the cleaning blade 61, a supporting member for supporting these members, and the load cell for measuring a load exerted on the photosensitive drum 1. The supporting member of the cleaning blade 61 is movable relative to the photosensitive drum 1 and is capable of changing an entering (penetration) amount of the cleaning blade 1 into the photosensitive drum 1. The entering amount of the cleaning blade 61 is an amount in which the cleaning blade 61 is contacted to the photosensitive drum 1 and thereafter is further pressed against the photosensitive drum 1 toward an inside of the photosensitive drum 1 with respect to a radial direction of the photosensitive drum 1. This entering amount is represented by a distance, with respect to the radial direction of the photosensitive drum 1, between a tangential line at the contact portion of the photosensitive drum 1 and the cleaning blade 61 and the free end on the assumption that the cleaning blade 61 is not deformed. When the blade pressure is measured, the cleaning blade 61 is contacted to the load sensor, and the load sensor is pressed in an entering amount of the cleaning blade 61 used in an actual machine (product).

In this embodiment, the image forming region with respect to the longitudinal direction of the photosensitive drum 1 is divided into a plurality of sections, and the load cell was disposed at each of the sections. As a result, it is possible to measure the blade pressure at a plurality of positions with respect to the longitudinal direction of the cleaning blade 61. In this embodiment, the image forming region with respect to the longitudinal direction of the photosensitive drum 1 was divided into 5 sections equally. A load (g) measured by the load cell at each of the sections is partial pressure (also referred to as "partial blade pressure") applied by the cleaning blade 61 to the photosensitive drum 1.

In this embodiment, partial blade pressure per unit longitudinal length (line pressure) (g/cm), of the cleaning blade 61, obtained by dividing the value of the load (g) measured by the load cell by a longitudinal width (cm) of the photosensitive drum 1 at each section was used. However, the value of the load (g) measured by the load cell may also be used as it is.

As regards the blade pressure to be measured, a variation generates, for example, every individual cleaning device 6 or every production lot of the cleaning device 6. This variation in blade pressure generates due to a manufacturing variation of the cleaning blade 61 alone in some cases. For example, the variation in blade pressure generates due to a thickness, a dimension of a free length, rubber hardness of the rubber portion 61*a* of the cleaning blade 61, an extrusion amount, a thickness or the like of an adhesive when the rubber portion 61*a* is bonded to the supporting portion 61*b*. Further, this variation blade pressure also generates due to a manufacturing variation of the cleaning device 6 in some cases. For example, the variation in blade pressure generates due to a variation depending on mechanical accuracy of the spring, the metal plate and the like constituting the cleaning device 6. For this reason, there is a tendency that the variation in blade pressure is larger with an increasing number of parts constituting the cleaning device 6.

The measurement of the blade pressure can be carried out every unit for which there is a possibility of generation of the variation in blade pressure having the influence on the discrimination of the deposited state of the deposited matter on the charging roller 2. For example, the blade pressure measurement can be carried out every individual cleaning blade 61 (drum cartridge 10), every production lot of the cleaning blade 61 (drum cartridge 10), or the like. In this embodiment, the blade pressure measurement is carried out every production lot of the drum cartridge 10 by using a representative constituent part of the drum cartridge 10. In the case where the representative constituent part is used, blade pressure measured using a pair of constituent parts may be used or blade pressure measured using a plurality of pairs of constituent parts may also be used.

7. Storing Portion

Figure 4:
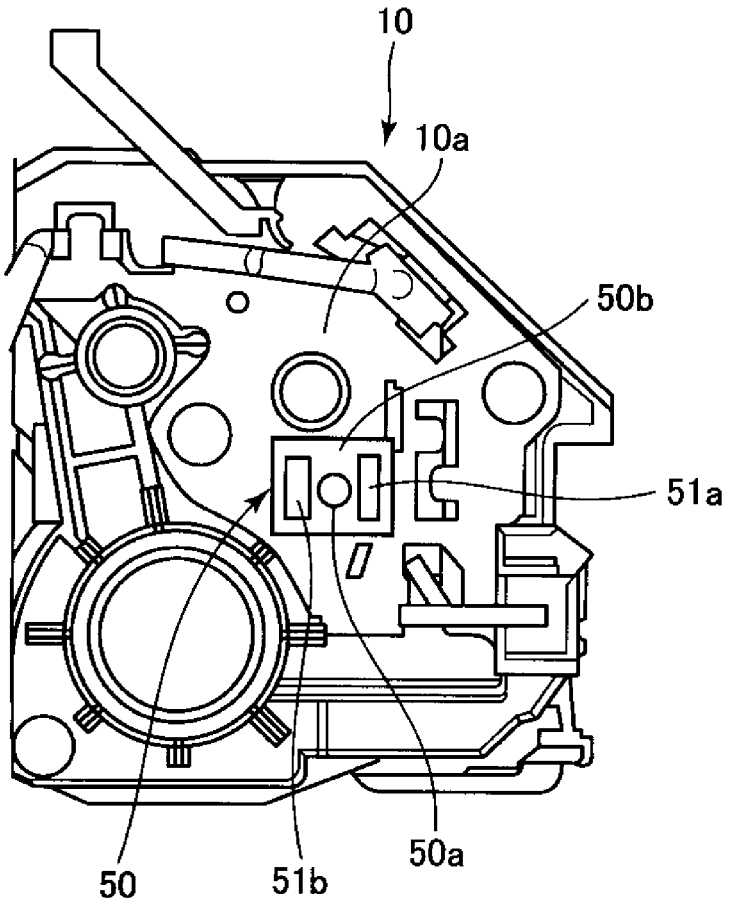
FIG. 4 is a side view of a drum cartridge.

FIG. 4 is a side view showing a side surface of the drum cartridge 10 at one longitudinal end portion in this embodiment. In this embodiment, a side cover 10*a* of the drum cartridge 10 is provided with a cartridge storing portion (tag) 50 as an information storing means. In this embodiment, the cartridge storing portion 50 includes a memory chip 50*a* which is a storing element such as RAM and ROM, and contact portions 51*a*, 51*b* on a substrate 50*b*. The substrate 50*b* is provided with a circuit for reading information from and writing the information in the memory chip 50*a* through the contact portions 51*a*, 51*b*. The memory chip 50*a* is disposed at a substantially central portion of the cartridge storing portion 50 and has a constitution in which a storing element is protected by a resin coating layer (protective portion). The contact portions 51*a*, 51*b* are communicatably connected with main assembly contact portions (not shown) provided in the apparatus main assembly 110 side in order to read the information from the memory chip 50*a* and write the information in the memory chip 50*a*. In this embodiment, the contact portions 51*a*, 51*b* are two gold-plated phosphor bronze plates mounted on the substrate 50*b*. Further, the contact portions 51*a*, 51*b* are substantially flush with the memory chip 50*a* and are disposed in both sides of the memory chip 50*a*. The main assembly contact portions are connected with the controller (control substrate) 30 (FIG. 5) provided in the apparatus main assembly 110. The controller 30 is capable of reading the information from the memory chip 50*a* of the cartridge storing portion 50 and writing the information in the memory chip 50*a* through the main assembly contact portions and the contact portions 51*a*, 51*b* of the cartridge storing portion 50.

By inputting necessary information in the memory chip 50*a* in advance, when the drum cartridge 10 is mounted in the apparatus main assembly 110, exchange of information between the drum cartridge 10 and the controller 30 of the apparatus main assembly 110 is carried out, so that it is possible to send the necessary information to the controller 30. Into the memory chip 50*a*, information can be inputted by a predetermined jig or the like during manufacturing, factory shipment and the like of the drum cartridge 10.

In this embodiment, in the memory chip 50*a*, information on at least, as the blade pressure, information on the partial blade pressure at each section with respect to the longitudinal direction is stored. The information on the partial blade pressure at each section with respect to the longitudinal direction is obtained by measuring the blade pressure as described above during assembling of the drum cartridge 10 and then by associating a longitudinal section (position) and the partial blade pressure with each other.

Particularly, in this embodiment, when the drum cartridge 10 is mounted in the apparatus main assembly 110, the information on the blade pressure is transferred from the cartridge storing portion to the main assembly storing portion 81 (FIG. 5) as an information storing portion provided in the apparatus main assembly 110. The main assembly storing portion 81 includes storing elements such as RAM and ROM, and the controller 30 can effect reading of the information from the main assembly storing portion 81 and writing of the information in the main assembly storing portion 81. That is, in this embodiment, when the drum cartridge 10 is mounted in the apparatus main assembly 110, the information on the blade pressure stored in the cartridge storing portion 50 is inputted into the controller 30 of the apparatus main assembly 110. Then, the controller 30 stores the inputted information on the blade pressure in the main assembly storing portion 81. Then, the controller 30 reads the information on the blade pressure stored in the main assembly storing portion 81 and uses the information in the control during the mounting of the drum cartridge 10 in the apparatus main assembly 110.

In the cartridge storing portion 50, information, other than the information on the blade pressure, such as lot numbers of the drum cartridge 10 and the cleaning blade 61, individual identification information of the drum cartridge 10 and the like may also be stored.

Further, even when the drum cartridge 10 is used, as desired, it is possible to write the information in the cartridge storing portion 50 at any time.

8. Deposited State of Deposited Matter on Charging Roller

An operation for discriminating the deposited state of the deposited matter on the charging roller 2 in this embodiment will be described. In this embodiment, a single image forming portion S will be described as a representative, but a similar operation is performed at all of the image forming portions S.

Figure 6:
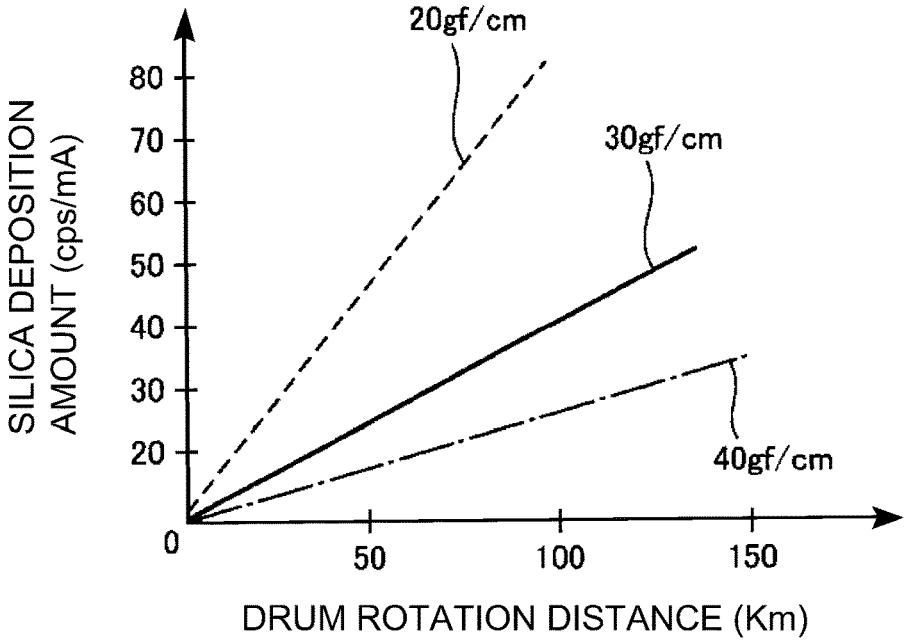
FIG. 6 is a graph showing a relationship between a rotation distance of a photosensitive drum and an accumulation amount of a deposited matter on a charging roller.

As described above, particles of the toner and the external additive for the toner which passed through the cleaning blade 61 are gradually transferred and accumulated on the charging roller 2. FIG. 6 shows a result, at different blade pressures, of a relationship between a rotation distance of the charging roller 2 (drum cartridge 10) from a new (initial) state and an accumulation amount of the deposited matter on the charging roller 2 in the image forming apparatus 100 in this embodiment. In this embodiment, a durability test in which images of 15% in image duty (image area ratio, print ratio) were continuously formed on A4-sized sheets in a both-side image forming mode was conducted. As the accumulation amount of the deposited matter on the charging roller 2, an accumulation amount of silica, contained in the external additive, having a high ratio occupying the particles passing through the cleaning blade 61 was measured as a representative value. For measurement, an X-ray analytical microscope ("XGT-5000 SERIES", manufactured by HORIBA Ltd.) was used. The accumulation amount is indicated by an indicated value (cps/mA) of the X-ray analytical microscope.

From FIG. 6, it is understood that the accumulation amount increases in proportional to the rotation distance of the photosensitive drum 1. Further, from FIG. 6, it is understood that there is a tendency that the accumulation amount increases with a decreasing blade pressure. This is because a frictional force between the cleaning blade 61 and the photosensitive drum 1 is lower with the decreasing blade pressure and therefore fine particles are liable to pass through the cleaning blade 61. On the other hand, as a result of a further test, also in the case where the blade pressure is larger than those in FIG. 6, it was confirmed that the amount of the fine particles passing through the cleaning blade 61 increased. This is because the frictional force between the cleaning blade 61 and the photosensitive drum 1 excessively increases due to an excessively high blade pressure and the cleaning blade 61 is placed in an unstable operation state such as vibration and therefore the particles in a large amount pass through the cleaning blade 61. Thus, it is understood that the deposited state of the deposited matter on the charging roller 2 with respect to the use amount of the charging roller 2 changes depending on the blade pressure.

In the constitution in this embodiment, a threshold (accumulation amount threshold) regarded as the lifetime of the charging roller, i.e., the drum cartridge 10 in this embodiment was 70 (ops/mA). That is, in the case where the deposited matter accumulates on the charging roller 2 to the extent that the X-ray analytical microscope indicates 70 (cps/mA) by the above-described measurement, there is a possibility of generation of the image defect such as the image non-uniformity. Specifically the accumulation amount, threshold corresponds to the case where an image density non-uniformity ΔD generated by charging non-uniformity with respect to the longitudinal direction of the photosensitive drum 1 due to the accumulation of the deposited matter on the charging roller 2 is 0.05 or more. Incidentally, for measurement of the image density, a densitometer ("Model 504", manufactured by X-Rite Inc.) was used.

In this embodiment, on the basis of the relationship (accumulation amount characteristic) between the rotation distance of the photosensitive drum 1 and the accumulation amount for each blade pressure as shown in FIG. 6, from the image non-uniformity on the blade pressure and the information on the rotation distance of the photosensitive drum 1, the deposited state of the deposited matter on the charging roller 2 is discriminated. In this embodiment, the accumulation amount characteristic as shown in FIG. 6 is obtained in advance and is stored in the main assembly storing portion 81. Further, in this embodiment, as described above, as the information on the blade pressure, the partial blade pressure at each of the sections with respect to the longitudinal direction is stored in the cartridge storing portion 50.

A specific procedure will be described later, but roughly, the deposited state of the deposited matter on the charging roller 2 can be discriminated in the following manner. First, from pieces of information on partial blade pressure at the respective longitudinal sections, the information on the lowest partial blade pressure is extracted, and a rotation distance of the photosensitive drum 1 in which the accumulation amount reaches the accumulation amount threshold in the case of the lowest partial blade pressure. The rotation distance of the photosensitive drum 1 is used as a reference value (100%) regarded as the end of the lifetime of the charging roller 2 (drum cartridge 10), and a current deterioration progress degree of the charging roller 2 with respect to the reference is acquired every job. The deterioration progress degree can be stored in the main assembly storing portion 81, for example. Then, for example, at the operating portion 81 (FIG. 5) provided on the apparatus main assembly 110, the deterioration progress degree can be checked. Further, in the case where the deterioration progress degree reaches a predetermined value, for example, it is possible to automatically notify an operator of that the charging roller 2 (drum cartridge 10) approaches the end of the lifetime thereof or reaches the end of the lifetime thereof.

The accumulation amount threshold is not limited to that in this embodiment. For example, the accumulation amount threshold can be appropriately set depending on a target value of the accumulation amount regarded as the end of the lifetime of the charging roller 2 (drum cartridge 10). Further, also a material providing the accumulation amount used as the representative value indicating the deposited state of the deposited matter on the charging roller 2 is not limited to silica. For example, the material may also be another material contained in the toner or calcium resulting from the recording material P and may also be a combination of a plurality of materials. The material may only be required to be a material which passes through the cleaning blade 61 and deposits on the charging roller 2 depending on the blade pressure and which is correlated with a degree of progress of deterioration (lowering in function) of the charging roller 2.

Further, in this embodiment, as the information on the use amount of the charging roller 2, the rotation distance of the photosensitive drum 1 was used, but the information is not limited thereto. The information may also be, for example, other parameters, such as a rotational frequency and a rotation time of the photosensitive drum 1, a rotation distance, a rotational frequency, a rotation time of the charging roller 2, a charging distance (rotation distance of the photosensitive drum 1 or the charging roller 2 subjected to a charging process), a charging time (time in which the charging process is performed) and the like. The information may only be required to be correlated with the use amount of the charging roller 2.

Further, in this embodiment, as the representative value of the blade pressure, the lowest partial blade pressure, of the partial blade pressures at the respective sections with respect to the longitudinal direction, at which the passing of the toner through the cleaning blade is liable to generate was used, but the present invention is not limited thereto. For example, in a constitution in which a distribution of the blade pressure with respect to the longitudinal direction is stable, an average value of the partial blade pressures with respect to the longitudinal direction or a total pressure which is the sum of the partial blade pressures with respect to the longitudinal direction may also be used.

9. Control Flow

Figure 7:
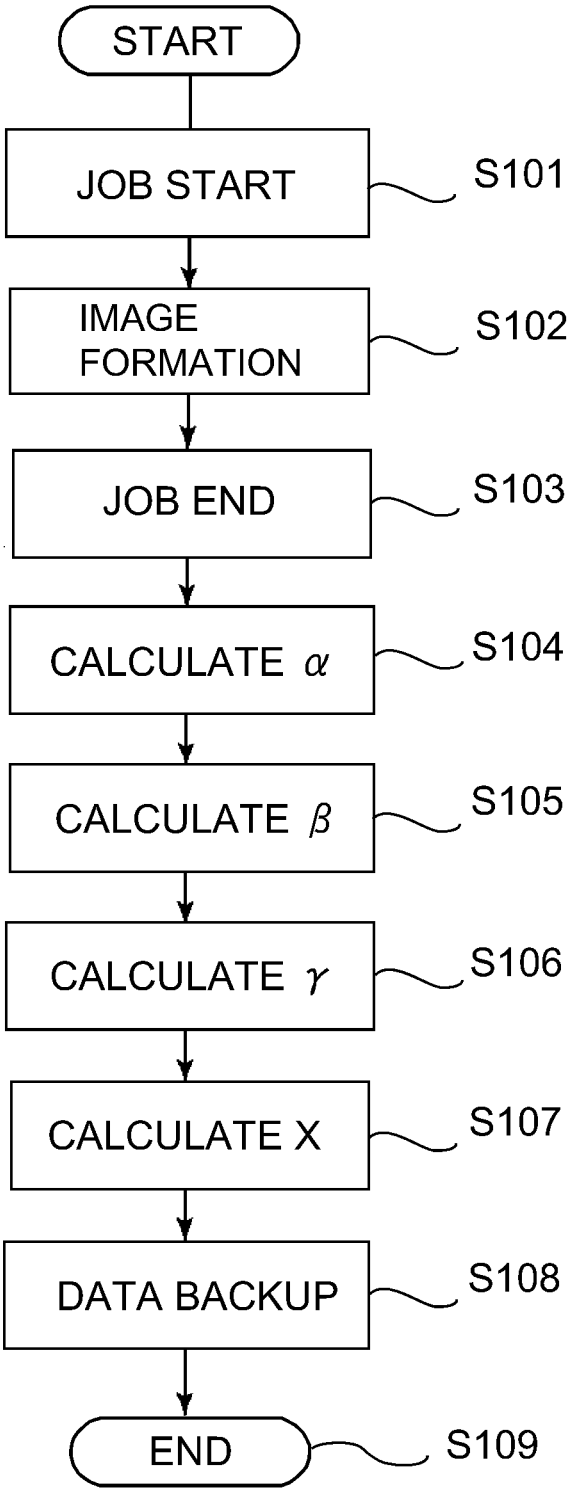
FIG. 7 is a flowchart showing an operation for discriminating a deposited state of the deposited matter on the charging roller.

A procedure of an operation for discriminating the deposited state of the deposited matter on the charging roller 2 in this embodiment will be described with reference to a flowchart of FIG. 7. In this embodiment, control of this operation is carried out by the controller 30 of the apparatus main assembly 110.

The controller 30 starts a job (S101) and carries out an image forming step (S102). When the job is ended (S103), the controller 30 acquires an accumulation amount characteristic, depending on the blade pressure, of the drum cartridge 10 mounted in the apparatus main assembly 110, in the following manner (S104). That is, the controller 30 extracts the information on the lowest partial blade pressure from the pieces of information on the partial blade pressures stored in the main assembly storing portion 81. Then, the controller 30 acquires an accumulation coefficient α corresponding to a slope of the accumulation amount characteristic corresponding to the extracted partial blade pressure, from the accumulation amount characteristic (FIG. 6) for each of the blade pressures stored in the main assembly storing portion 81. Then, the controller 30 acquires a rotation distance β of the photosensitive drum 1 in the current job by functioning as a use amount detecting means of the charging roller 2 (S105). Then, the controller 30 calculates an index value γ indicating the accumulation amount of the deposited matter on the charging roller 2 in accordance with a formula (1) shown below (S106). That is, the controller 30 reads the index value γ stored in the main assembly storing portion 81, which is an integrated value of the product of the accumulation coefficient α and the rotation distance β. Then, the controller 30 calculates a new index value γ by adding, to the read index value γ, the product of the accumulation coefficient α and the rotation distance β in the current job. The controller 30 stores the calculated new index value γ in the main assembly storing portion 81 and thus renews the index value γ in the main assembly storing portion 81.

$$\gamma=\Sigma(\alpha\times\beta) \quad (1)$$

Then, the controller 30 calculates a deterioration progress degree X (%) of the current charging roller 2 (drum cartridge 10) in accordance with a formula (2) shown below (S107). That is, the controller 30 calculates the deterioration progress degree X (%) from a threshold Z (70 (cps/mA)) of the accumulation amount stored in the main assembly storing portion 81 and the renewed index value γ calculated as described above.

$$X=\gamma/Z\times100(\%) \quad (2)$$

Then, the controller 30 stores the current deterioration progress degree X, calculated as described above, in the main assembly storing portion 81 and thus renews the deterioration progress degree X in the main assembly storing portion 81 (S108).

Here, in this embodiment, the information on the use amount of the charging roller 2, the information on the index value indicating the deposited state of the deposited matter on the charging roller 2, and the information on the deterioration progress degree of the charging roller 2 (drum cartridge 10) are also stored in the cartridge storing portion 50 at any time. In the case where the drum cartridge 10 is mounted in and demounted from the apparatus main assembly 110, when these pieces of the information are stored in the cartridge storing portion 50, the controller 30 stores these pieces of the information together with the information on the blade pressure in the main assembly storing portion 81. As a result, it becomes possible to always effect control in conformity with the drum cartridge 10 mounted in the apparatus main assembly 110.

Figure 8:
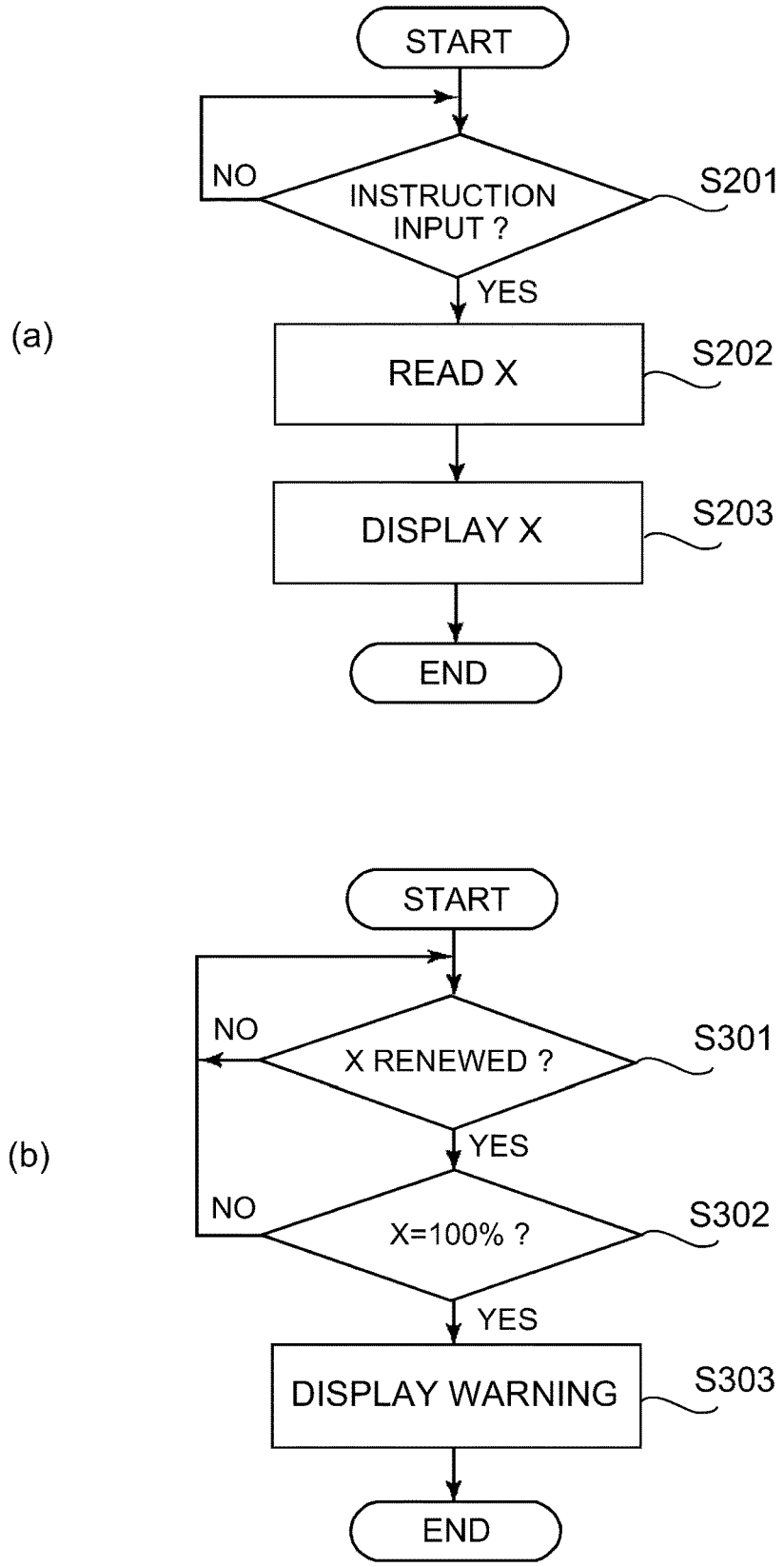
In FIG. 8, (a) and (b) are flowcharts each showing notification of information on a lifetime of the charging roller.

Next, with reference to FIG. 8, a procedure of an operation for notifying the information on the lifetime of the charging roller 2 (drum cartridge 10) will be described. In this embodiment, control of this operation is carried out by the controller 30 of the apparatus main assembly 110. In FIG. 8, (a) shows the procedure of the operation in the case where depending on an instruction from an operator, the information on the lifetime of the charging roller 2 (drum cartridge 10) is notified. In this embodiment, an operator such as a user or a service representative can arbitrarily check the information on the blade pressure through the operating portion 82 provided on the apparatus main assembly 110. The operating portion 82 has functions as an inputting means such as keys for inputting instructions into the controller 30 and as a displaying means such as a liquid crystal panel for displaying a state or the like of the image forming apparatus 100.

In this case, when an instruction to display the deterioration progress degree X is inputted from the operating portion 81 (S201), the controller 30 reads the current deterioration progress degree X from the main assembly storing portion 81 (S202). Then, the controller 30 displays the read current deterioration progress degree X on the operating portion 82 (S203).

In FIG. 8, (b) shows the procedure of the operation in the case where the information on the lifetime of the charging roller 2 (drum cartridge 10) is notified when the deterioration progress degree X reaches a predetermined value. In this embodiment, in the case where the deterioration progress degree X reaches 100%, warning display is carried out at the operating portion 82 provided on the apparatus main assembly 110.

In this case, when the deterioration progress degree X (stored in the main assembly storing portion 81 is renewed (S301), the controller 30 discriminates whether or not the deterioration progress degree X reached 100% (S302). Then, in the case where the deterioration progress degree X reaches 100%, the controller 30 causes the operating portion 82 to effect the warning display for prompting the operator to exchange the drum cartridge 10 (S303).

Incidentally, the information on the lifetime may also be displayed at a displaying means of an external device such as a personal computer communicatably connected with the apparatus main assembly 110, in accordance with an instruction from an inputting means of the external device. Further, the information on the lifetime may also be always displayed on the operating portion 82 or the like of the apparatus main assembly 110, for example, during actuation or during image formation of the image forming apparatus 100. Further, timing when the warning display is effected is not limited to the case where the deterioration progress degree X reached 100 &, but the operator may also be prompted to prepare the exchange at an earlier timing (timing when the deterioration progress degree X is a smaller value). Further, the warning display may also be effected at a plurality stages such that warning of the approach of the lifetime is made and then warning of the end of the lifetime is made. Further, a notifying (displaying) method of the deterioration progress degree X and the warning is not limited to a visual method such as characters or symbols, but may also be an auditory method such as voice or alarm.

Thus, in this embodiment, the image forming apparatus 100 includes the controller for carrying out the process for notifying the information on the lifetime of the charging member 2 on the basis of use amount information on the use amount of the charging member 2 and contact pressure information on the contact pressure applied by the cleaning member 61 to the photosensitive member 1. In this embodiment, the controller 30 acquires the index value corresponding to the use amount information by using relational information, corresponding to the contact pressure information, of relational information indicating the use amount information and the index value indicating the deposited state of the deposited matter on the charging member, for each contact pressure. Particularly, in this embodiment, the relationship for each contact pressure is such that a ratio of an increase in index value to an increase in use amount is larger in the case where the contact pressure is a second contact pressure smaller than a first contact pressure than in the case where the contact pressure is the first contact pressure. Further, in this embodiment, the contact pressure information includes a plurality of pieces of partial pressure information on the contact pressure at a plurality of longitudinal positions of the contact portion between the photosensitive member 1 and the cleaning member 61. Further, the controller 30 acquires the index value by using one (the smallest partial pressure information in this embodiment) of the plurality of pieces of the partial pressure information.

Further, in this embodiment, as a process for notifying the information on the lifetime of the charging member 2, the controller 30 carries out a process in which the controller 30 compares the acquired index value with a predetermined threshold to acquire the deterioration progress degree of the charging member 2 and stores the deterioration progress degree in the storing portion 81. Further, the controller 30 is capable of carrying out the process of displaying the deterioration progress degree depending on an instruction and the process of displaying the warning in the case where the deterioration progress degree reached the predetermined value. Further, the controller 30 is capable of storing at least one of the contact pressure information, the use amount information, the information on the index value and the information on the deterioration progress degree in the storing portion 50 provided in the cartridge 10.

As described above, according to this embodiment, it becomes possible to estimate the deposited state of the deposited matter on the charging roller 2 with accuracy, so that it becomes possible to discriminate the lifetime of the charging roller 2, i.e., the drum cartridge 10 in this embodiment, with accuracy.

[Embodiment 2]

Then, another embodiment of the present invention will be described. A basic constitution and an operation of an image forming apparatus in this embodiment are the same as those in Embodiment 1. Accordingly, in the image forming apparatus in this embodiment, elements having the same or corresponding functions and constitutions as those in Embodiment 1 are represented by the same reference numerals or symbols and will be omitted from description.

An amount of the particles passing through the cleaning blade 61 is correlated with an amount of the toner reaching the cleaning blade 61. The amount of the toner remaining on the photosensitive drum 1 without being transferred at the primary transfer portion N1 becomes larger with a higher image duty (image area ratio, print ratio) and therefore the amount of the particles, passing through the cleaning blade 61, such as particles of the external additive or the like liberated from the toner becomes large.

Figure 9:
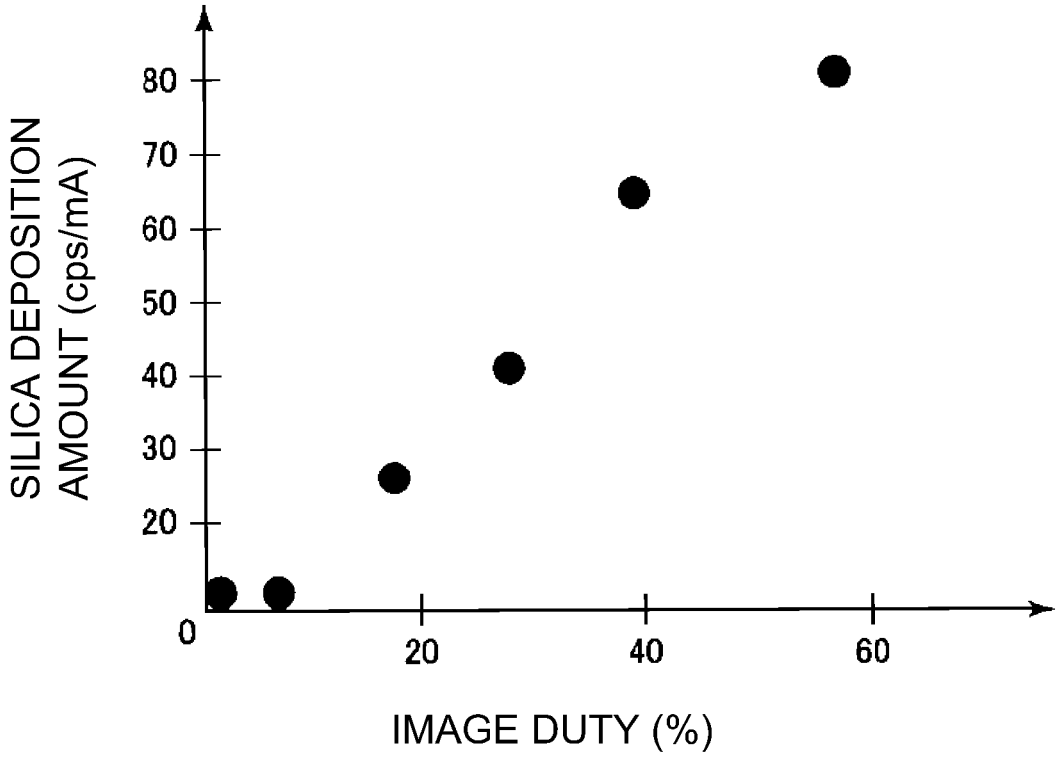
FIG. 9 is a graph showing a relationship between an image duty and the accumulation amount of the deposited matter on the charging roller.

FIG. 9 shows a result of study on a relationship between the image duty and the accumulation amount (deposition amount) of the deposited matter on the charging roller 2. In this embodiment, a durability test in which the image duty is changed and images are continuously formed on A4-sized sheets in a both-surface image forming mode, and then the accumulation amount was checked at timing when the rotation distance of the photosensitive drum 1 is 100 km. The measurement of the accumulation amount was carried out similarly as in Embodiment 1. From FIG. 9, it is understood that the accumulation amount increases with an increasing image duty.

Therefore, in this embodiment, the controller 30 functions as a toner amount detecting means for detecting the amount of the toner reaching the cleaning blade 61 and calculates an average image duty for each of jobs. That is, the controller 30 calculates, on the basis of image information, an image duty for each image formed on a single recording material in the job, and then calculates the average image duty by dividing the sum of the calculated image duties by the number of the formed images. Then, the controller 30 carries out, depending on the average image duty, a process of multiplying the rotation distance of the photosensitive drum 1 in the current job by a coefficient (residual toner amount coefficient) A.

Table 1 shows a relationship between the average image duty and the residual toner amount coefficient A. In this embodiment, information indicating this relationship is acquired in advance and is stored in the main assembly storing portion 81. Incidentally, the controller 30 calculates the residual toner amount coefficient A between respective average image duties shown in Table 1 by linear interpolation (calculation).

TABLE 1

| Image duty | RTAC*[1] A |
|---|---|
| 0% | 0 |
| 5% | 0.3 |
| 15% | 1.0 |
| 30% | 2.0 |
| 50% | 3.0 |
| 100% | 4.0 |

*[1]"RTAC" is the residual toner amount coefficient.

The residual toner amount coefficient A is, as shown in a formula (3) below, reflected in an index value γ indicating the accumulation amount of the deposited matter on the charging roller 2. Incidentally, the calculation of the deterioration progress degree X, the operation of notifying the deterioration progress degree X, and the like can be the same as those in Embodiment 1.

$$\gamma=\Sigma(\alpha\times\beta\times A) \quad (3)$$

When compared with the case where the average image duty is 15%, in the case where the average image duty is 30%, even when the image formation is effected in the same mode, the residual toner amount coefficient is twice, and therefore also the deterioration progress degree X progresses at a speed which is twice that in the case of the average image duty of 15%.

In this embodiment, as the information on the amount of the toner reaching the cleaning blade 61, the image duty was used, but the information is not limited thereto. For example, an absolute amount of the toner, an average of a toner amount per unit area, and the like may also be used. In this embodiment, the information indicating the relationship as shown in Table 1 was stored in the main assembly storing portion 81, but may also be stored in the cartridge storing portion 50.

Thus, in this embodiment, the controller corrects the use amount information depending on the amount of the toner remaining on the photosensitive member 1 after the transfer and then acquires the index value indicating the deposited state of the deposited matter on the charging member by using the corrected use amount information. Particularly, in this embodiment, the correction depending on the remaining toner amount is made so that the use amount indicated by the use amount information is larger in the case where the residual toner amount is a second amount larger than a first amount than in the case where the remaining toner amount is the first amount.

As described above, according to this embodiment, depending on the image duty, it becomes possible to discriminate the deposited state of the deposited matter on the charging roller 2 with accuracy.

[Embodiment 3]

Then, another embodiment of the present invention will be described. A basic constitution and an operation of an image forming apparatus in this embodiment are the same as those in Embodiment 1. Accordingly, in the image forming apparatus in this embodiment, elements having the same or corresponding functions and constitutions as those in Embodiment 1 are represented by the same reference numerals or symbols and will be omitted from description.

Even when the deposited state of the deposited matter on the charging roller 2 is the same, the case where the deposited matter is readily visualized as the image non-uniformity depending on an environment (at least one of a temperature and a humidity in at least one of an inside and an outside of the image forming apparatus) in which the image formation is effected and the case where the deposited matter is not readily visualized as the image non-uniformity exist. Specifically, the deposited matter is not readily visualized in a high-humidity environment and is readily visualized in a low-humidity environment. This may be attributable to the following reason. That is, the surface of the photosensitive drum 1 is charged by applying a high voltage to the charging roller 2. At this time, in the high-humidity environment, even when the accumulation amount of the deposited matter on the charging roller 2 is relatively large, a surface resistance of the charging roller 2 does not readily cause non-uniformity. For that reason, when the high voltage is applied to the charging roller 2, a charge potential of the photosensitive drum 1 does not readily cause non-uniformity. On the other hand, in the low-humidity environment, the surface resistance of the charging roller 2 readily causes the non-uniformity. For that reason, when the high voltage is applied to the charging roller 2, the charge potential of the photosensitive drum 1 readily causes the non-uniformity, so that the image non-uniformity is liable to generate.

Therefore, in this embodiment, when the job is executed, the controller 30 reads a detection result of a humidity (relative humidity) by a temperature/humidity sensor 83 (FIG. 1) as an environment detecting means provided inside the apparatus main assembly 110. Then, the controller 30 carries out, after the current job, a process of multiplying an associated value by a coefficient (environmental coefficient) B when the index value γ described in Embodiment 1 is calculated.

Table 2 shows a relationship between an ambient humidity and the environmental coefficient B. In this embodiment, information indicating this relationship is acquired in advance and is stored in the main assembly storing portion 81. Incidentally, the controller 30 calculates the environmental coefficient B between respective ambient humidity values shown in Table 2 by linear interpolation (calculation).

TABLE 2

| Humidity | AC*[1] B |
|---|---|
| 0% | 1.5 |
| 20% | 1.2 |
| 40% | 1.0 |
| 60% | 0.6 |
| 80% | 0.3 |
| 100% | 0.2 |

*[1]"AC" is the ambient coefficient.

The ambient coefficient B is, as shown in a formula (4) below, reflected in an index value γ indicating the accumulation amount of the deposited matter on the charging roller 2. Incidentally, the calculation of the deterioration progress degree X, the operation of notifying the deterioration progress degree X, and the like can be the same as those in Embodiment 1.

$$\gamma=\Sigma(\alpha\times\beta\times B) \quad (4)$$

There is a tendency that the amount of the deposited matter such as the toner and the external additive thereof which pass through the cleaning blade 61 is larger in the low-humidity environment than in the high-humidity environment. That is, in the developing device 4, burying of the external additive in the toner is more liable to generate in the low-humidity environment than in the high-humidity environment, so that the external additive is not readily liberated. For that reason, the external additive having the function of suppressing passing through the contact portion between the cleaning blade 61 and the photosensitive drum 1 by deposition thereof at the contact portion is more liable to be depleted in the low-humidity environment than in the high-humidity environment. For that reason, in this embodiment, for each job, the index value γ calculated by multiplying an associated value by the ambient coefficient B is integrated and stored. However, the present invention is not limited thereto, but the index value γ may also be not only integrated and stored similarly as in Embodiment 1 but also, when the current deterioration progress degree X is calculated, be calculated as an index value γ obtained by multiplying the index value γ integrated up to now by the ambient coefficient B depending on the current ambient humidity.

In this embodiment, as the information on the ambient humidity, the relative humidity was used, but the information is not limited thereto. For example, an absolute value of water content may also be used. In this embodiment, the information indicating the relationship as shown in Table 2 was stored in the main assembly storing portion 81, but may also be stored in the cartridge storing portion 50.

Further, control depending on the environmental (ambient) information in this embodiment and control depending on the residual toner amount information in Embodiment 2 may also be carried out in combination.

Thus, in this embodiment, the controller corrects the acquired index value indicating the deposited state of the deposited matter on the charging member, depending on the environmental information. Particularly, in this embodiment, the correction depending on the environmental information is made so that the accumulation amount, of the deposited matter on the charging member, indicated by the information is larger in the case where the humidity indicated by the environmental information is a second humidity lower than a first humidity than in the case where the humidity indicated by the environmental information is the first humidity.

As described above, according to this embodiment, it becomes possible to discriminate the deposited state of the deposited matter on the charging roller 2 with accuracy in consideration of ease of generation of the inconvenience such as the image non-uniformity due to the environment (image defect generation sensitivity).

[Embodiment 4]

Then, another embodiment of the present invention will be described. A basic constitution and an operation of an image forming apparatus in this embodiment are the same as those in Embodiment 1. Accordingly, in the image forming apparatus in this embodiment, elements having the same or corresponding functions and constitutions as those in Embodiment 1 are represented by the same reference numerals or symbols and will be omitted from description.

In the above-described embodiments, the information on the blade pressure was stored in the cartridge storing portion 50 and then was stored in the main assembly storing portion 81 when the drum cartridge 10 was mounted in the apparatus main assembly 110, and was used in the control by the controller 30. However, the method of notifying the information on the blade pressure is not limited thereto.

For example, the operator such as the user or the service representative can input the information on the blade pressure through the operating portion 82 or the like of the apparatus main assembly 110. That is, a provider of the drum cartridge 10 can present the information on the blade pressure through any means every individual cleaning blade 61 (drum cartridge 10) or every production lot of the cleaning blade 61 (drum cartridge 10). For example, the provider can present the information in the form of the drum cartridge itself, a package of the drum cartridge 10, an article distributed together with the drum cartridge 10 such as a manual, or on a web site of a provider of the image forming apparatus through a network. The operator inputs the information on the blade pressure into the controller 30 by an operation at the operating portion 82 of the apparatus main assembly 110. Then, the controller 30 stores the inputted information on the blade pressure in the main assembly storing portion 81. Then, the controller 30 reads the information on the blade pressure stored in the main assembly storing portion 81 and uses the information during the mounting of the drum cartridge 10 in the apparatus main assembly 110. Incidentally, the blade pressure information may also be inputted from an operating portion of an external device such as a personal computer communicatably connected with the apparatus main assembly 110.

Further, the information inputted from the operating portion 82 of the apparatus main assembly 110 is not required to be the information itself on the blade pressure. If the information can identifying the information on the blade pressure for the drum cartridge 10 mounted in the apparatus main assembly 110, the information may also be, e.g., a lot number, an individual identification number, or the like of the drum cartridge 10. For example, the case where the apparatus main assembly 110 is connected with the network through a network connecting portion 84 (FIG. 5) as an inputting means will be described. In this case, for example, the information on the blade pressure is associated with the lot number (or the individual identification number) of the drum cartridge 10 and is stored in an external storing portion (not shown) in a service depot of the provider of the image forming apparatus 100. This external storing portion and the apparatus main assembly 110 are connected through the network. Then, the provider inputs the lot number, of the drum cartridge 10 mounted into the apparatus main assembly 110, from the operating portion 82 of the apparatus main assembly 110 into the controller 30. The lot number of the drum cartridge 10 can be presented in the form of the drum cartridge 10 itself, or the package of the drum cartridge 10 or the article, such as the manual, distributed together with the drum cartridge 10. Then, the controller 30 acquires the information on the blade pressure corresponding to the inputted lot number of the drum cartridge 10 from the external storing portion. Further, the controller 30 stores the acquired information on the blade pressure in the main assembly storing portion 81. Then, the controller 30 reads the information on the blade pressure stored in the main assembly storing portion 81 and uses the information in the control during the mounting of the drum cartridge 10 in the apparatus main assembly 110. Incidentally, the lot number may also be inputted from the operating portion of the external device such as the personal computer communicatably connected with the apparatus main assembly 110.

Incidentally, the information on the accumulation amount characteristic (FIG. 6), the information on the residual toner amount coefficient (Table 1) and the information on the environmental coefficient (Table 2) may also be stored in the above-described storing portion. The controller 30 acquires these pieces of information from the external storing portion (and may also further store the pieces of information in the main assembly storing portion 81), and can use the pieces of information in the control. Further, the pieces of information on the blade pressure, the use amount information, the information on the index value, the information on the deterioration progress degree, the information on the blade pressure, and the like may also be stored only in the cartridge storing portion 50. Similarly, the information on the accumulation amount characteristic (FIG. 6), the information on the residual toner amount coefficient (Table 1) and the information on the ambient coefficient (Table 2) may also be stored in the cartridge storing portion 50.

(Other Embodiments)

The present invention was described based on the specific embodiments mentioned above, but is not limited to the above-mentioned embodiments.

In the above-described embodiments, in the image forming apparatus, the drum cartridge integrally including the photosensitive member, the cleaning means and the charging means is detachably mountable to the apparatus main assembly was used, but the present invention is not limited thereto. For example, the photosensitive member, and as the process means actable on the photosensitive member, the charging means, the developing means and the cleaning means may also be integrally assembled into a process cartridge detachably mountable to the apparatus main assembly. Further, the information is not required to be of a cartridge mounting and demounting type. The cleaning members and the charging member may also be individually exchangeable.

Further, in the above-described embodiments, the case where the blade pressure was different depending on the manufacturing variation was described as an example, but the present invention is not limited thereto. For example, the present invention is applicable even in the case where the setting of the blade pressure is intentionally changed due to an arbitrary reason such as a change in setting due to a difference in type (model) of the image forming apparatus, a change in setting due to a use (operation) environment or use status of the image forming apparatus by the user, or the like.

Further, the present invention can also be applied to a cleaning member for a single photosensitive member in an image forming apparatus including only the single photosensitive member as the image bearing member.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2016-022166 filed on Feb. 8, 2016, which is hereby incorporated by reference herein in its entirety.

What is claimed is:

1. A cartridge detachably mountable to a main assembly of an image forming apparatus comprising:

a photosensitive drum on which a toner image is formed;

a cleaning blade provided in contact with said photosensitive drum and configured to remove a toner remaining on a surface of said photosensitive drum; and a storing portion configured to store pressure information on contact pressure of said cleaning blade to said photosensitive drum, wherein said photosensitive drum includes a first area within an image forming area where the toner image is formable and a second area different from the first area with respect to a longitudinal direction of said cleaning blade within the image forming area, and wherein the pressure information includes first partial pressure information on the contact pressure of a first contact portion between the first area and said cleaning blade and second partial pressure information on the contact pressure of a second contact portion between the second area and said cleaning blade.

2. A cartridge according to claim 1, wherein a variation of the first and second pressure information is due to a manufacturing variation of said cleaning blade.

3. A cartridge according to claim 1, wherein said storing portion includes a memory element.

4. A cartridge according to claim 3, wherein said storing portion includes contact portions adapted to connect with portions of the main assembly.

5. A cartridge according to claim 1, further comprising a charging member configured to electrically charge said photosensitive drum.

6. A cartridge according to claim 1, wherein a position of said cleaning blade relative to said photosensitive drum is movable so as to adjust a penetration amount of said cleaning blade into said photosensitive drum.

7. A cartridge according to claim 1, wherein the pressure information is information measured during assembling of said cartridge.

8. A cartridge according to claim 7, wherein the pressure information is information measured by using a load sensor of a measuring jig.

* * * * *